US005286074A

United States Patent [19]

Lin

[11] Patent Number: 5,286,074

[45] Date of Patent: Feb. 15, 1994

[54] HANDLE LOCK

[76] Inventor: Jui-Chang Lin, No. 297, Bor-Ay Road, Kaohsiung, Taiwan

[21] Appl. No.: 21,114

[22] Filed: Feb. 23, 1993

[51] Int. Cl.[5] ..... E05C 1/16

[52] U.S. Cl. ..... 292/336.3; 292/244; 292/357; 292/359; 292/150

[58] Field of Search ..... 292/357, 150, 358, 359, 292/350, 244, 336.3, 226, 169 R

[56] References Cited

U.S. PATENT DOCUMENTS 2,264,420 12/1941 Voight ..... 292/359
2,547,108 4/1951 Anderson ..... 292/150 X
4,453,753 6/1984 Fayerman et al. ..... 292/169 X
4,470,279 9/1984 Neary et al. ..... 292/359 X

*Primary Examiner*—Richard E. Moore
*Attorney, Agent, or Firm*—Jacobson, Price, Holman & Stern

[57] ABSTRACT

A handle lock having two handles to be symmetrically fixed on the inner and the outer bearing plate fixed on the inner and the outer side of a door, each handle assembled with a tubular shaft and a square shaft to retract a dead bolt to open the door, a locking rod combined in the inner bearing plate and being movable therein to permit the tubular shaft either to be rotated to open the door or to be prevented from being rotated by the handle either outer or inner, to lock the door.

5 Claims, 4 Drawing Sheets

HANDLE LOCK

BACKGROUND OF THE INVENTION

A conventional handle lock generally used for doors of bathrooms and restrooms has a round-shaped knob, being locked without a key but with a push button in the inner knob of the lock for locking it from the inside of the door, which can be opened in an emergency from the outside by means of a coin fitted in and rotating a groove in the outside knob after when locked. However, the round knob is rather inconvenient for the invalid, the disabled or children to manipulate open. So some makers have changed the round knob into a curved handle making easy to open a door by pressing it down, and generally made by molding. But a handle made by molding is liable to break, so a handle made of copper has also been made through a wrought process, having decorative and strong feature but impossible to be combined with a handle lock with a push button locking mechanism, as those made of aluminum or steel.

SUMMARY OF THE INVENTION

This invention has an object to overcome the disadvantages of conventional handle locks mentioned above.

The handle lock in the present invention comprises an inner and an outer bearing plate fixed on the inner and the outer surface of a door, a tubular shaft combined with each of both bearing plates in a central shaft hole therein, two handles and two drive members each consisting of a coil spring and a drive plate. The two drive plates have a square hole for a square shaft to engage therein to be combined between the two drive plates. The inner bearing plate is combined with a locking rod, which can be pressed inward or pulled outward in a hole in the inner plate. When the locking rod is pressed in, the handle lock is locked, impossible to open the door from the outside, with the outer handle being stopped immovable by the locking rod.

DETAILED DESCRIPTION OF THE INVENTION

Figure 1:
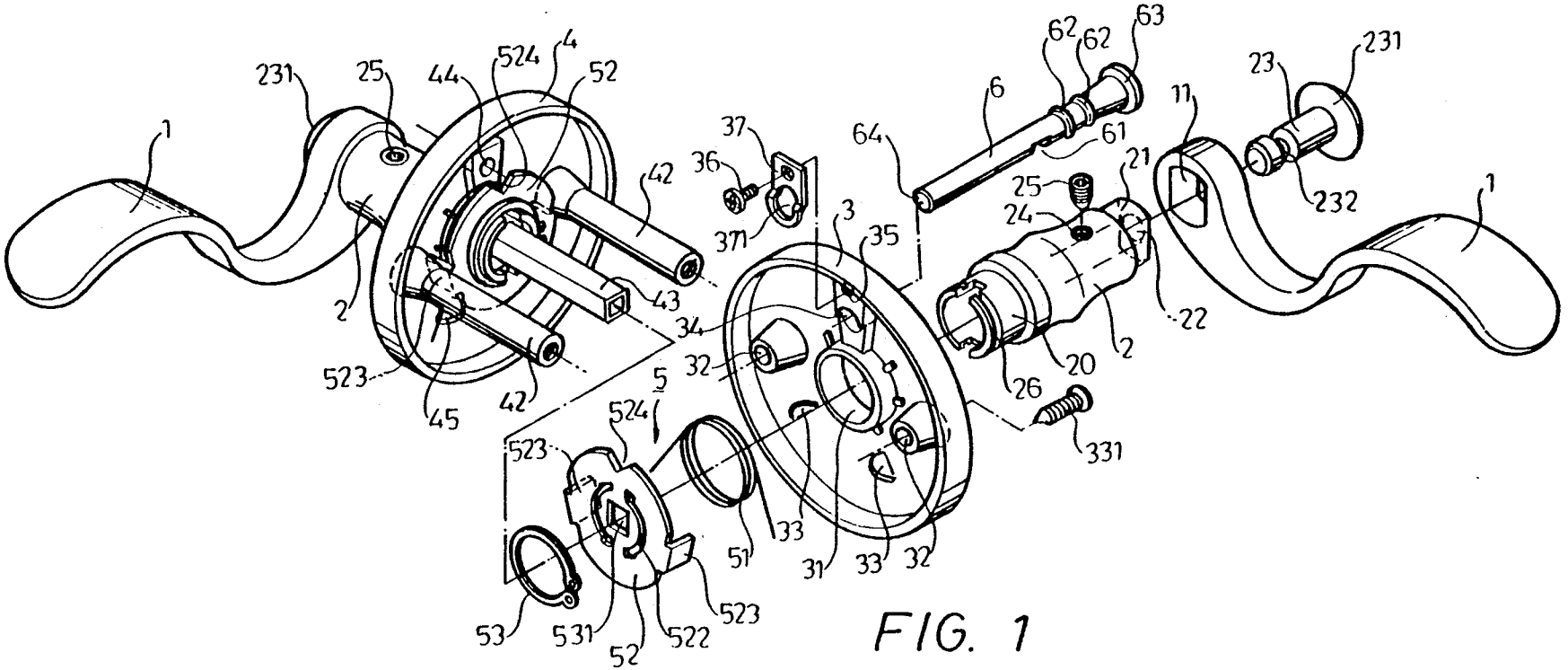
FIG. 1 is an exploded perspective view of a handle lock in the present invention.

A handle lock in the present invention, as shown in FIG. 1, comprises two handles 1, 1, two tubular shafts 2, an inner bearing plate 3, an outer bearing plate 4, two drive members 5, 5 and a locking rod 6 as main components.

The two handles are respectively shaped as double curved in opposite direction to each other, having a non-round combining hole in one end to fit with an end projection 21 of each tubular shaft 2 so that each handle 1 can rotate each tubular shaft 2.

The tubular shafts 2, 2 are adapted to fit and pass through two shaft holes 31, 41 of the inner and the outer bearing plates 3, 4, having combining projections 21, 21 in both ends to fit in the combining holes 11, 11 of two handles 1, 1, round lengthwise holes 22, 22 in both outer ends for small-diameter rod portions of caps 23, 23 to fit therein. Large diameter heads 231, 231 of the caps 23, 23 are stopped by the surrounding edges of the round holes 11, 11, of the handles 1, 1 to assemble the shafts 2, 2 with the handles 1, 1 together. The caps 23, 23 also have an annular grooves 232, 232 near the bottom ends in line with screw holes 24, 24 of the shafts 2, 2 communicating with the round holes 22, 22 for screws 25, 25 to engage therein and the annular grooves 232, 232 so that the handles 1, 1, the shafts 2, 2 and the caps 23, 23 can be combined firmly together. The shafts 2, 2 have a small-diameter portion 20 to engage the shaft holes 31, 41 of the inner and the outer bearing plates 3, 4. The small diameter portion 20 is located to protrude out of the outer sides of both the inner and the outer bearing plates 3, 4 for the drive members 5, 5 of two coil springs 51, 51 and drive plates 52, 52 to fit around, and a pair of annular grooves 26, 26 for a C ring to engage therein for preventing the springs 51, 51 and the drive plates 52, 52 from falling off and for keeping the shafts 2, 2 and the inner and the outer bearing plates 3, 4 combined together.

The inner bearing plate 3 is fixed on the inside surface of a door having a central shaft hole 31 for the inner shaft 2 to pass through, two combining holes 32, 32 for two screws 331, 331 to pass through engage two posts 42, 42 of the outer bearing plate 4, two projections 33, 33 extending from an inner side for hooking two ends of each spring 51 thereon, a locating hole 34 with a sloped inner surface for a locking rod 6 to insert therein, a screw hole 35 for a screw 36 to engage for fixing a locating plate 37, which has a hole 371 and plate 37, which has a hole 371 and a bottom side engaging a notch 61 of the locking rod 6 so as to limit the the rod 6 to move in a definite distance of the length of the notch 61.

The outer bearing plate 4 is fixed on the outer surface of a door, and combined with the outer handle 1, the outer tubular shaft 2 and one of the drive member 5, having two posts 42, 42 with female threads for the screws 331, 331 to engage so as to fix the outer and the inner bearing plates 3, 4 on the door. The outer bearing plate 4 has a small straight hole 44 in line with the locating hole 34 of the inner bearing plate 3, but may not have the screw hole 35 and the locating plate 37 the inner bearing plate 3 has.

The two drive members 5 respectively consist of a coil spring 51 and a drive plate 52 to rotate elastically each handles 1 back to its original position after the handle is rotated. Each coil spring 51 fits around small-diameter portion 20 of each tubular shaft 2, having both ends hooked on two projections 33, 33 or 45, 45 of the inner or the outer bearing plate 3, or 4. Each drive plate 52 has a square hole 521 for the square shaft 43 to pass through so that rotation of either of the handles 1, 1 can cause rotation of the square shaft 43, and two semi-circular slots 522, 522 for the wall of each tubular shaft 2 to insert there-through so as to make each shaft 2 and each drive plate 52 rotate together. Each drive plate 52 also has two bent feet 523, 523 to contact both ends of each spring 51 so that the feet 523, 523 can press the spring 51 to rotate shrinkingly and then to lengthen resiliently to make the drive plate 52 rotate back to its original position, and a notch 524 for the locking rod 6 to lie thereon.

The locking rod 6 is adapted to prevent the outer handle 1 from being rotated, fitted in a locating hole 34 of the inner bearing plate 3, with its large diameter ridges 62, 62 engaging an inner surface of the hole 34 when the rod 6 is pressed in. The hole 34 has a sloped inner surface, letting the locking rod 6 impossible to move when the rod 6 is pressed therein deep but possible to move when the rod 6 is pulled outward therein, by pressing in or pulling outward the rod 6 at the inside of the door. And the rod 6 also has a small-diameter end 64 to engage the notch 524 of the drive plate 52 of the outer bearing plate 4 for locking it immovable in case of pressing in the rod 6, and a notch 61 to engage the bottom edge of the hole 371 of the locating plate 37, keeping the rod 6 not separated from the inner bearing plate 3 when the rod 6 is pulled outward and enabling the drive plate 52 of the inner bearing plate 3 to rotate, with the notch 61 of the rod 6 positioning above the notch 524 of the drive plate 52 of the inner bearing plate 3.

Figure 2:
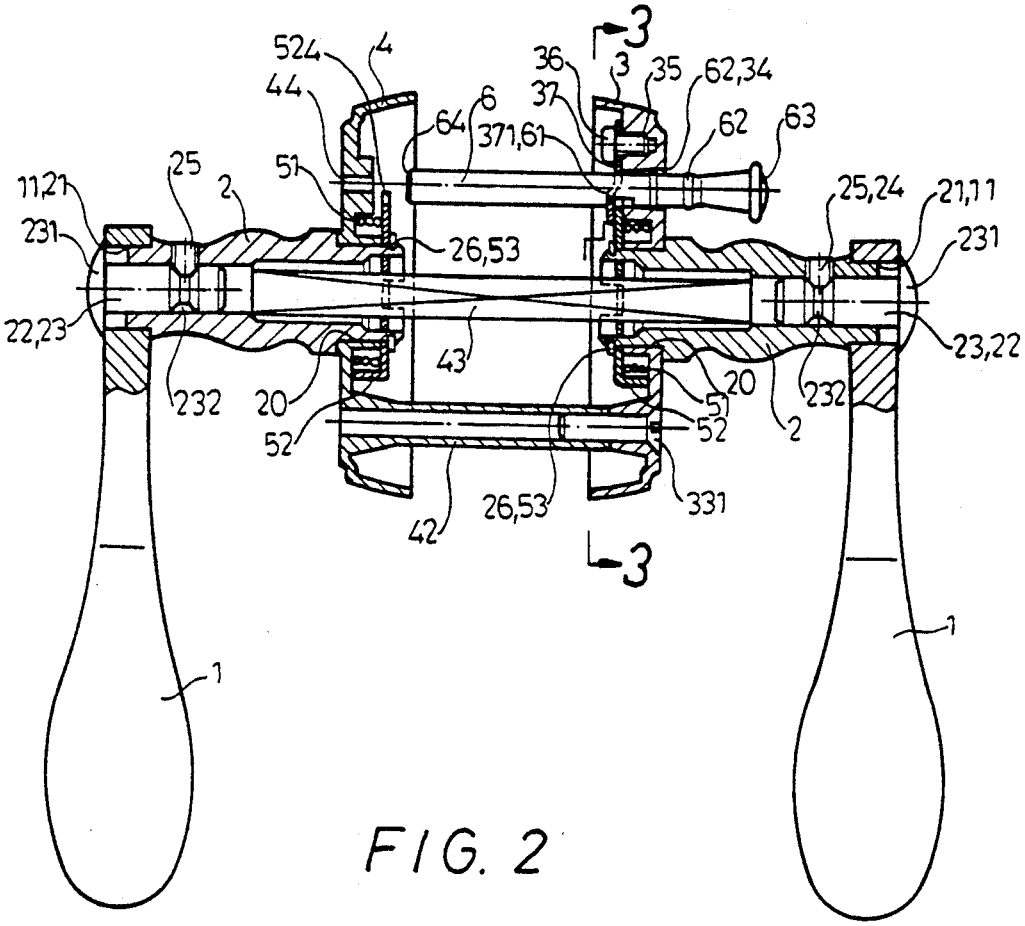
FIG. 2 is a cross-sectional view of line 2—2 in FIG. 3.
Figure 3:
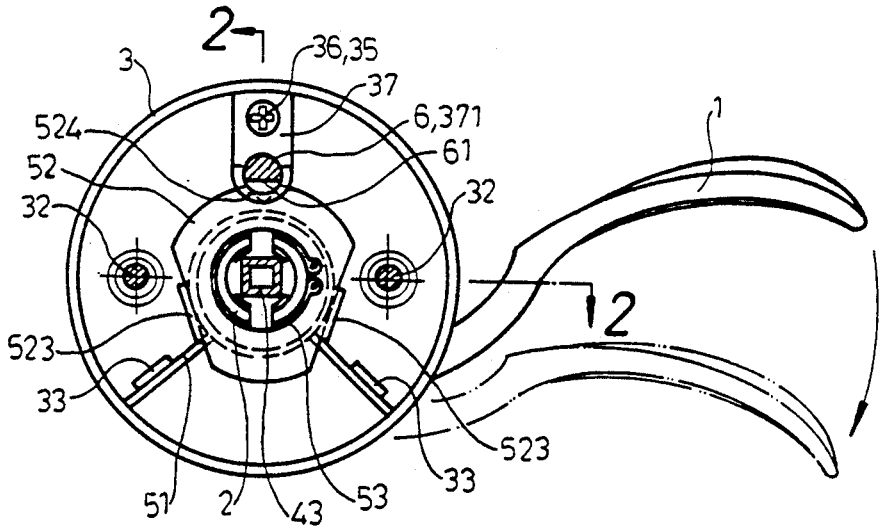
FIG. 3 is a cross-sectional view of line 3—3 in FIG. 2.

FIGS. 2 and 3 show this handle lock in unlocked position, wherein the locking rod 6 is in a first position of being not pressed in in the hole 34 and the hole 371, with the small-diameter end 64 separated from the notch 524 of the drive plate 52 fixed on the outer bearing plate 4, and with the notch 61 of the locking rod 6 positioning above the drive plate 52 of the inner bearing plate 3. Consequently, both handles 1, 1 can be rotated to open the door, with the handle lock being in unlocked position.

Figure 6:
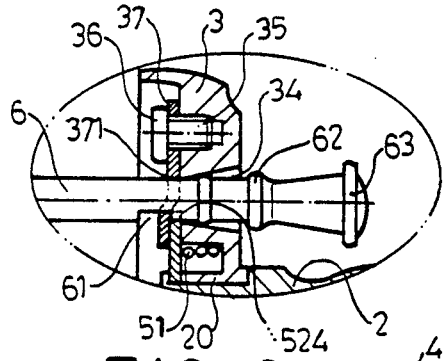
FIG. 6 is a magnified view of the part marked 6 in FIG. 4.
Figure 4:
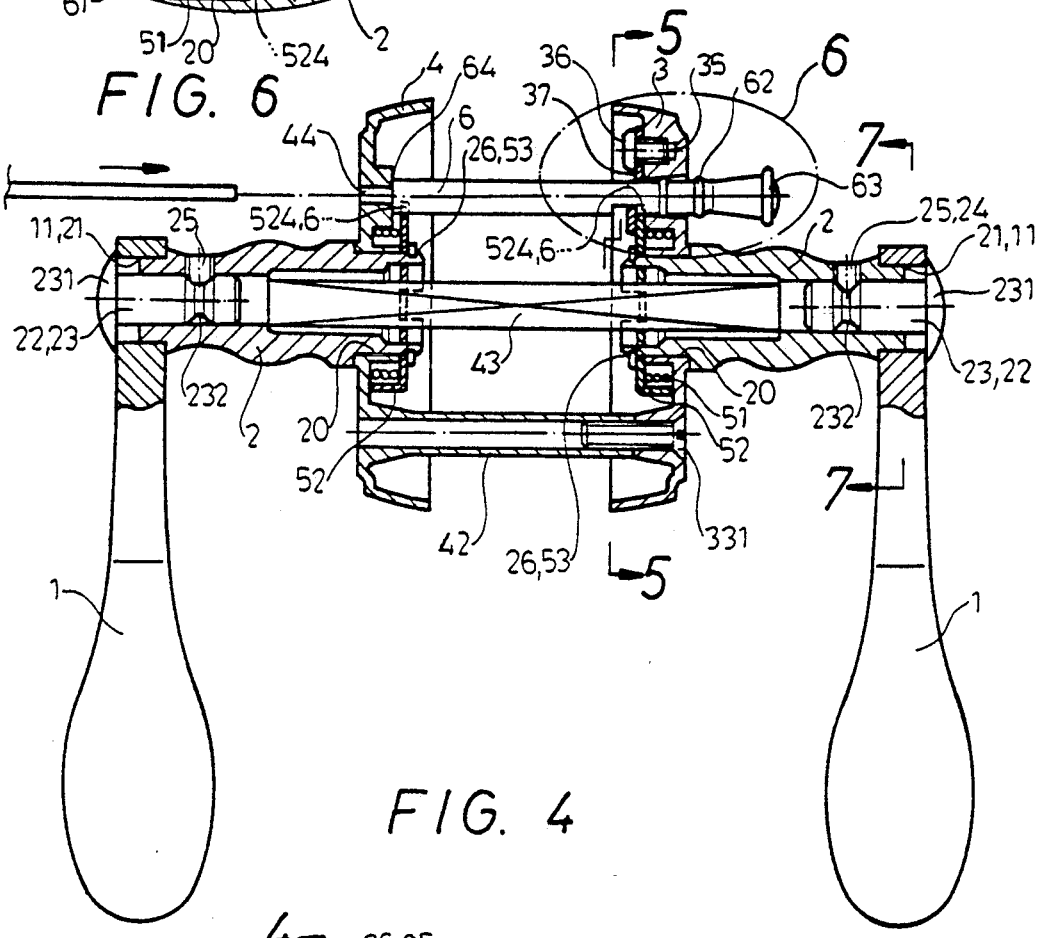
FIG. 4 shows an operational movement of FIG. 2.
Figure 5:
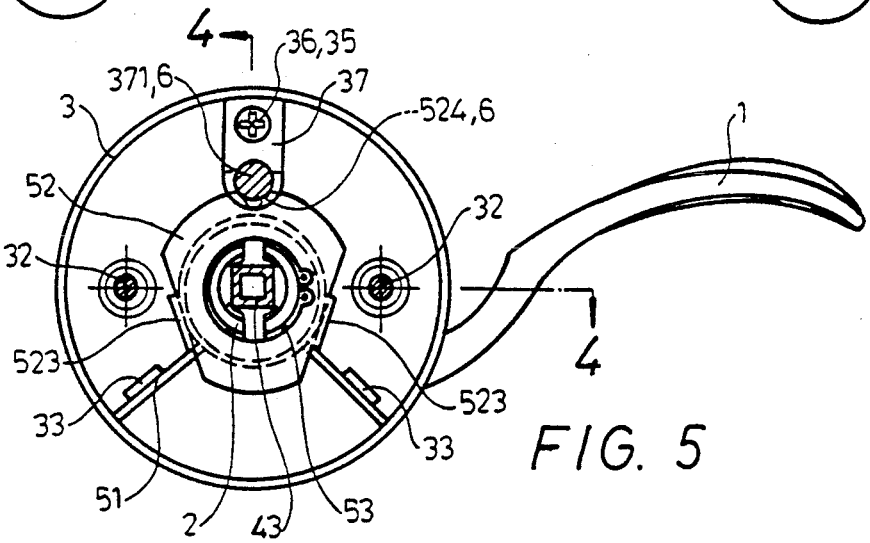
FIG. 5 is a cross-sectional view of line 5—5 in FIG. 4.
Figure 7:
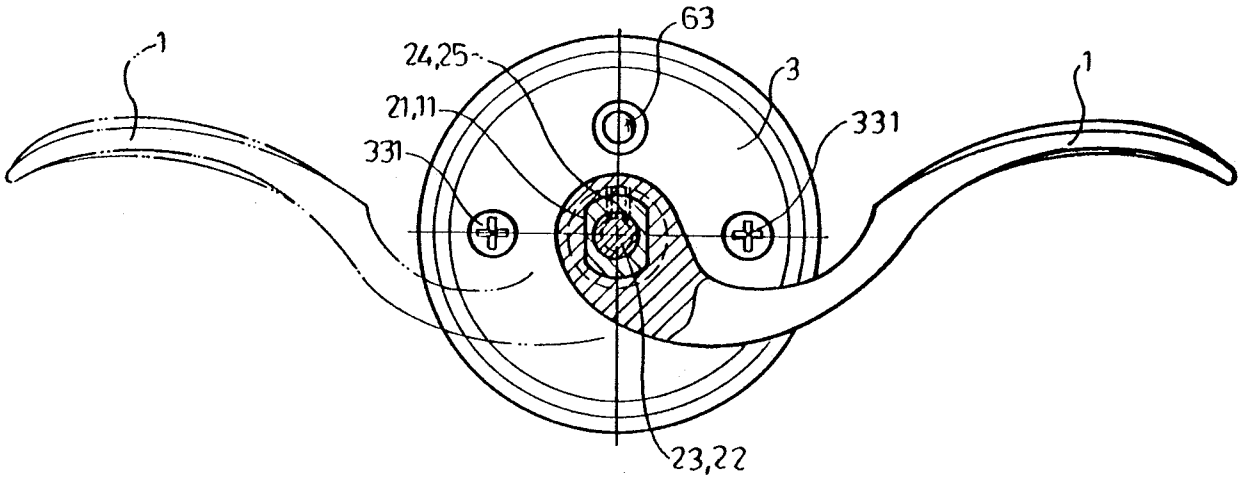
FIG. 7 is a cross-sectional view of line 7—7 in FIG. 4.

FIGS. 4, 5, 6 show this handle lock in locked position, wherein the locking rod 6 is in a second position wherein the rod 6 is forcefully pressed in with the large-diameter portions 62,62 engaging the locating hole 34 of the inner bearing plate 3, and with the notch 61 of the rod 6 leaving away from the notch 524 of the drive plate 52 fixed on the inner bearing plate 3 and with the outer surface of the rod 6 in contact with the notch 524. In addition, as shown in FIG. 4, the small-diameter end 64 of the rod 6 is extended deep to engage the notch 524 of the drive plate 52 of the outer bearing plate 4, locking the drive plates 52, 52 immovable and subsequently also preventing both handles 1, 1 inside and outside the door from rotating for opening the door.

In emergency and when this handle lock is in locked position but the door has to be opened from the outside, a very slender bar can be used to insert through the straight hole 44 of the outer bearing plate 4 and push the locking rod 6 back to the unlocked position (the first position) shown in FIG. 2. Then the handles 1, 1 can be rotated to open the door. p Should the handles 1, 1 be altered from the right side to the left side, only the screws 25, 25 are loosened to take out the caps 23, 23 so as to interchange both handles 1, 1 and the caps 23, 23 and the screws 25, 25 are to be fixed again.

What is claimed is:

1. A door handle structure comprising an inner handle assembly, an outer handle assembly, and a drive element interconnecting said assemblies and for operating a door latch, the inner handle assembly including an inner bearing plate for attachment to an inner surface of a door, an inner tubular shaft journalled in the inner bearing plate, an inner handle on the inner tubular shaft externally of the inner bearing plate and an inner drive plate carried by the inner tubular shaft for rotation therewith internally of the inner bearing plate, the outer handle assembly including an outer bearing plate for attachment to an outer surface of the door, an outer tubular shaft journalled in the outer bearing plate, an outer handle on the outer tubular shaft externally of the outer bearing plate and an outer drive plate carried by the outer tubular shaft for rotation therewith internally of the outer bearing plate, the drive element comprising a drive shaft extending between and rotationally interconnecting the inner and outer drive plates, the handle structure further including a locking mechanism comprising a locking notch in the outer drive plate, an inwardly tapering hole in the inner bearing plate, an axially movable locking rod having a large diameter proximal end portion received in said hole, and a small diameter distal end portion for movement into and out of said notch respectively to lock and unlock the structure, the rod having a first unlocked position wherein said distal end portion is removed from said notch and said proximal end portion is a loose fit in said tapering hole and a second locked position wherein said distal end portion is received in said notch and said proximal end portion is a tight fit in said tapering hole, wherein the locking rod includes an elongate peripheral slot and the locking mechanism further includes a locating plate internally attached to the inner bearing plate, the locating plate extending into said slot for limiting axial movements of the locking rod.

2. A door handle structure as claimed in claim 1, including a further locking notch in the inner drive plate, said further locking notch being adapted to receive a portion of the locking rod in the second position of the locking rod and to align with said slot in the first position of the locking rod.

3. A door handle structure as claimed in claim 1, including spring means connected between the respective drive plates and bearing plates for rotatably returning the structure to a rest position after one of the handles is operated to release the door latch.

4. A door handle structure as claimed in claim 1, wherein each handle comprises an elongate contoured handle reversibly mountable on the respective tubular shaft.

5. A door handle structure as claimed in claim 1, wherein the proximal end portion of the locking rod has a peripherally projecting ridge for tightly engaging said tapering hole in the second position of the rod.

* * * * *